US007918433B2

(12) United States Patent
Melton et al.

(10) Patent No.: US 7,918,433 B2
(45) Date of Patent: Apr. 5, 2011

(54) TRANSITION PIECE MOUNTING BRACKET AND RELATED METHOD

(75) Inventors: Patrick Melton, Horse Shoe, NC (US); Kyle Kidder, Ferndale, MI (US)

(73) Assignee: General Electric Company, Schenectady, NY (US)

( * ) Notice: Subject to any disclaimer, the term of this patent is extended or adjusted under 35 U.S.C. 154(b) by 300 days.

(21) Appl. No.: 12/213,828

(22) Filed: Jun. 25, 2008

(65) Prior Publication Data

US 2009/0321608 A1 Dec. 31, 2009

(51) Int. Cl.
*F16M 5/00* (2006.01)
*F16M 9/00* (2006.01)
*F02C 7/20* (2006.01)

(52) U.S. Cl. ..... 248/674; 248/220.21; 248/300; 60/796

(58) Field of Classification Search ..... 248/674, 248/675, 200, 220.21, 223.31, 223.41, 300, 248/316.8, 671; 60/39.37, 772, 796, 800
See application file for complete search history.

(56) References Cited

U.S. PATENT DOCUMENTS 1,635,847 A * 7/1927 Hooper ..... 248/675
3,337,172 A * 8/1967 Jackson ..... 248/222.51
4,040,589 A * 8/1977 McLay ..... 248/300
4,422,288 A 12/1983 Steber
4,465,284 A 8/1984 Szema
4,719,748 A 1/1988 Davis, Jr. et al.
5,414,999 A 5/1995 Barnes
5,716,898 A 2/1998 Derleth et al.
6,412,268 B1 7/2002 Cromer et al.
6,494,044 B1 12/2002 Bland
6,547,257 B2 4/2003 Cromer
6,904,756 B2 * 6/2005 Mack ..... 60/796
7,010,921 B2 3/2006 Intile et al.
7,373,772 B2 5/2008 Simons et al.
2009/0101788 A1 * 4/2009 Kidder et al. ..... 248/674

* cited by examiner

*Primary Examiner* — Anita M King
(74) *Attorney, Agent, or Firm* — Nixon & Vanderhye, P.C.

(57) ABSTRACT

A mounting bracket assembly includes: a first bracket component having a first pair of laterally spaced securement tabs; a second bracket component having a second pair of laterally spaced securement tabs; wherein said first and second bracket components are engageable with each other such that respective ones of each of the first and second pairs of securement tabs are located adjacent each other and adapted to engage corresponding pairs of recesses in a machine component. A related method of securing a transition piece to a combustor casing without welding includes: providing a first mounting bracket component for attaching the transition piece to a turbine combustor casing, the first mounting bracket formed with a first set of securement tabs; providing a second mounting bracket component that is usable with the first bracket component, the second mounting bracket component formed with a second set of securement tabs; and slidably engaging the transition piece with the first and second mounting bracket components, such that the first and second pairs of securement tabs are received within corresponding axially-aligned recesses provided on the transition piece, thereby permitting the transition piece to grow thermally relative to the first and second mounting bracket components.

17 Claims, 3 Drawing Sheets

TRANSITION PIECE MOUNTING BRACKET AND RELATED METHOD

This application relates generally to gas turbine combustor technology and, more specifically, to a mounting arrangement for the forward end of a transition piece (or duct) that carries hot gases from a combustor to a first stage of the turbine.

BACKGROUND OF THE INVENTION

The transition piece forward mounting bracket is a component of the turbine combustion system that supports a transition duct (commonly referred to as the "transition piece"), that extends between a combustor liner or casing and a first turbine stage in a can-annular gas turbine combustion configuration. The mounting bracket generally requires replacement after completion of a specified number of hours in operation (e.g., 8000 hours) because high stresses and wear in this area could possibly result in failure of the turbine. There are instances, however, where it would be desirable to increase the service life without significant cost increases.

BRIEF DESCRIPTION OF THE INVENTION

This invention provides a two-piece forward transition piece mounting bracket assembly wherein one piece of the bracket assembly can be used for a shorter life cycle interval but, when it is desired to extend service life, the second piece of the bracket may be added. In other words, the mounting bracket assembly comprises two discrete components, one of which is useable alone to achieve one specified service life, and both of which are useable in combination to achieve a significantly greater specified service life.

Thus, in accordance with one aspect, the present invention relates to a mounting bracket assembly comprising: a first bracket component having a first pair of laterally spaced securement tabs; a second bracket component having a second pair of laterally spaced securement tabs; wherein the first and second bracket components are engageable with each other such that respective ones of each of the first and second pairs of securement tabs are located adjacent each other and adapted to engage corresponding pairs of recesses in a machine component.

In another aspect, the invention relates to a mounting bracket component for securing one machine component to another machine component, the mounting bracket component comprising a first base portion with a first pair of arms extending upwardly and outwardly from the first base portion, the arms having in-turned edges forming a first set of securement tabs receivable in recesses formed in the other machine component, and the first base portion having a first mounting flange axially projecting from one side of the first base portion.

In still another aspect, the invention relates to a method of securing a transition piece to a combustor casing without welding comprising: providing a first mounting bracket component for attaching the transition piece to a turbine combustor casing, the first mounting bracket formed with a first set of securement tabs; providing a second mounting bracket component that is usable with the first bracket component, the second mounting bracket component formed with a second set of securement tabs; and slidably engaging the transition piece with the first and second mounting bracket components, such that the first and second pairs of securement tabs are received within corresponding axially-aligned recesses provided on the transition piece, thereby permitting the transition piece to grow thermally relative to the first and second mounting bracket components.

The invention will now be described in greater detail in connection with the drawings identified below.

DETAILED DESCRIPTION OF THE INVENTION

Figure 1:
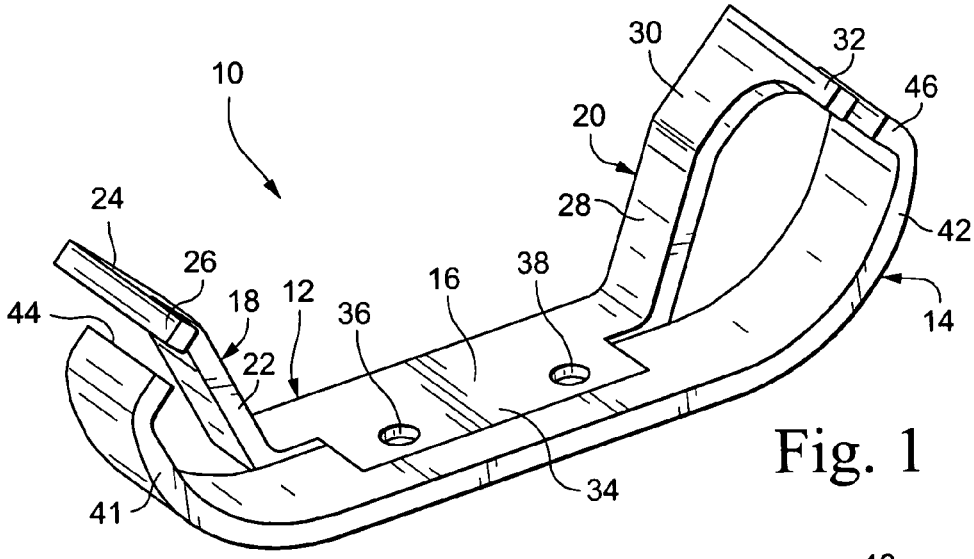
FIG. 1 is a perspective view of a non-limiting implementation of a two-piece transition piece mounting bracket assembly in accordance with the invention.
Figure 2:
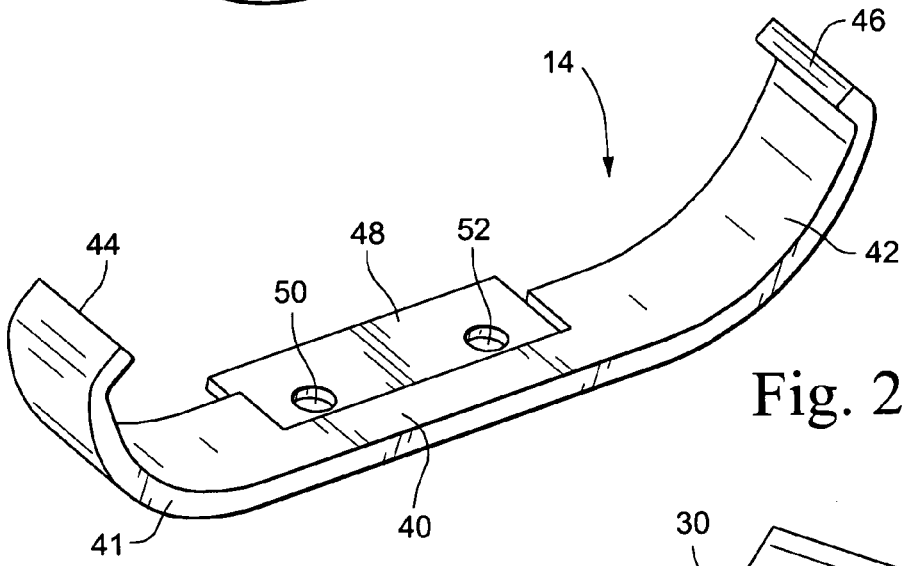
FIG. 2 is a perspective view of one of the two components shown in FIG. 1.
Figure 3:
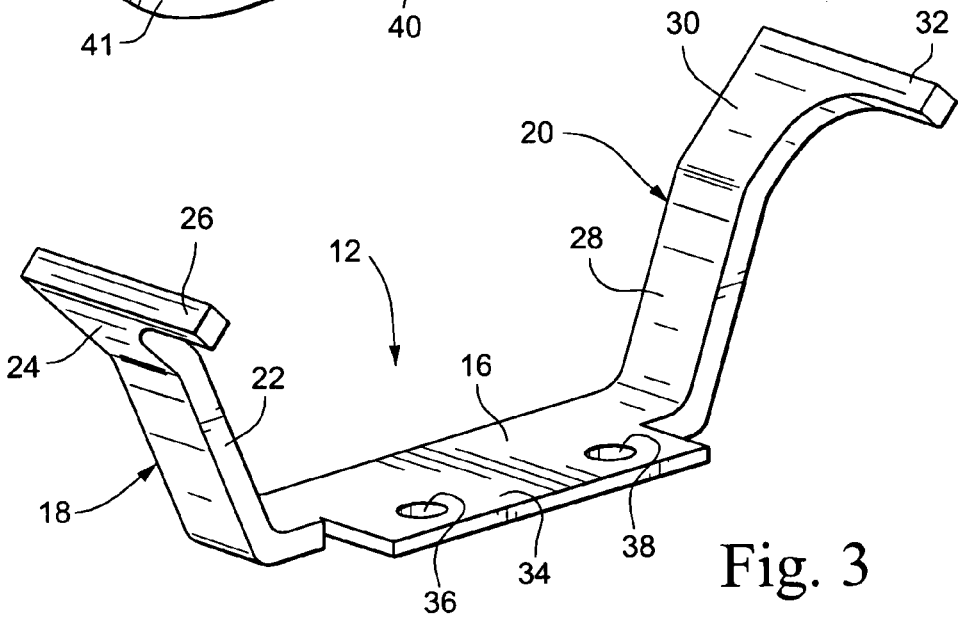
FIG. 3 is a perspective view of the other of the two components shown in FIG. 1.

With reference initially to FIGS. 1-3, the two-piece mounting bracket assembly 10 in accordance with a non-limiting exemplary embodiment includes a first generally U-shaped bracket component 12 and a second generally U-shaped bracket component 14. While both components are broadly described as being of generally U-shape, it will be appreciated from the drawings and the detailed description below that the shapes of the components 12 and 14 are significantly different. Nevertheless, the shapes of the components 12 and 14 may vary within the scope of the invention. Specific shapes may be dictated, for example, by the locations of the bracket mounting surfaces as found on the mounting platforms 34, 48 described below, in relation to the locations of associated H-blocks on the transition piece (see H-blocks 62 on transition piece 54 in FIG. 6), with due consideration for adequate clearance to access nearby components.

The first bracket component 12 includes a substantially flat base 16 and a pair of upwardly and outwardly extending arms 18 and 20 extending from opposite ends of the base 16. The arm 18 includes a first angled portion 22 and a second angled portion 24, portion 24 extending at a relatively shallower angle relative to the base 16 than the first angled portion 22. At the remote end of arm 18, there is an axially extending securement tab 26.

Similarly, arm 20 has a first angled portion 28 and a second angled portion 30, along with an axially-extending securement tab 32 at its remote end. Thus, it will be appreciated that arms 18 and 20 are substantial mirror images of one another, and securement tabs 26 and 32 collectively form a first set of securement tabs.

The base portion 16 is also provided with an axially projecting flange or support platform 34 provided with mounting holes 36, 38. The flange or platform 34 is recessed relative to the lower surface of the base 16 but substantially flush with the upper surface thereof.

The second mounting bracket component 14 includes a relatively flat base 40 and pair of curved, mirror-image arms 41, 42 extending outwardly and upwardly from opposite ends of the base. The arms 41, 42 lie laterally outwardly of arms 18, 20, and the outer or remote ends of the arms 41, 42 are formed with inwardly projecting edges that form a second set of securement tabs 44, 46, respectively.

Within the base 40, there is a flange or mounting platform 48 which is recessed relative to the upper surface of the base 40, but flush with the lower surface of the base. The flange or platform 48 is provided with mounting holes 50, 52.

With specific reference to FIG. 1, the offset mounting flange or platform configuration allows the flange or platform 34 to overlie the recessed flange or platform 48, with mounting holes 36, 38 aligned respectively with mounting holes 50, 52. Moreover, the oppositely recessed platforms 34 and 48, when fully engaged, serve to align and fix one component relative to the other while maintaining a slim profile in that the base portions 16 and 40 are substantially co-planar when the mating engaging surfaces, i.e., the upper surface of platform 48 and lower surface of platform 34 are engaged.

Figure 4:
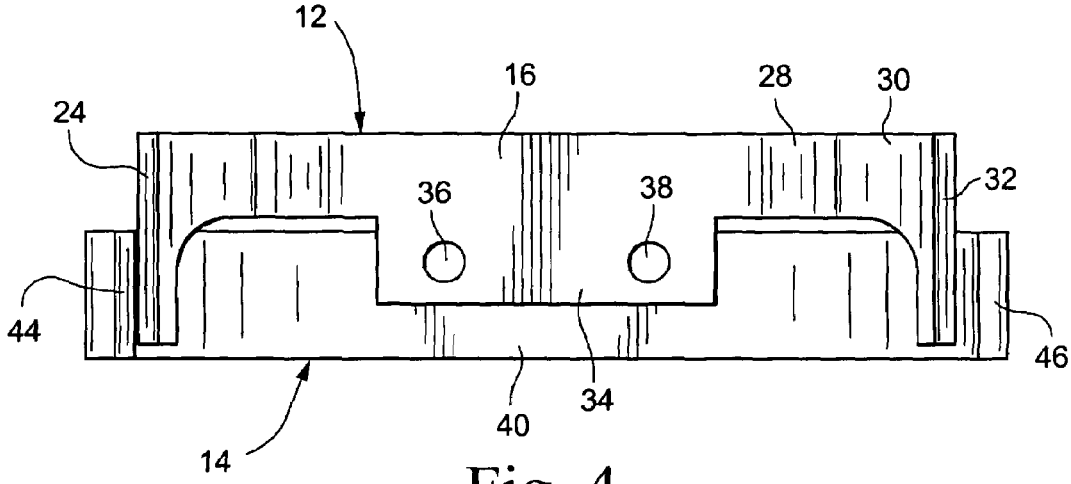
FIG. 4 is a plan view of the two-piece mounting bracket assembly shown in FIG. 1.
Figure 5:
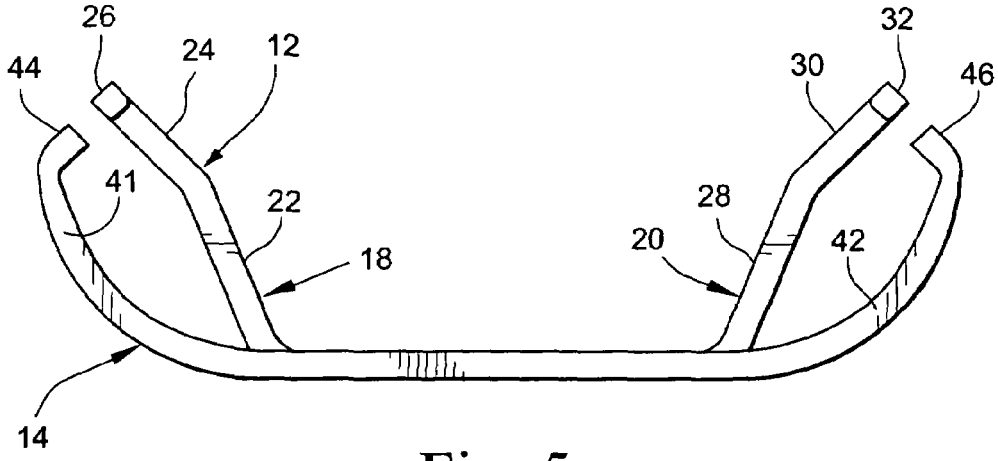
FIG. 5 is a front elevation of the assembly shown in FIG. 4.

As best seen in FIGS. 4 and 5, with the mounting bracket components 12 and 14 assembled as shown in FIG. 1, the first set of axially extending securement tabs 26, 32 on the first bracket component 12 extend parallel to and adjacent the second set of securement tabs 44, 46 on the second bracket component 14.

Figure 6:
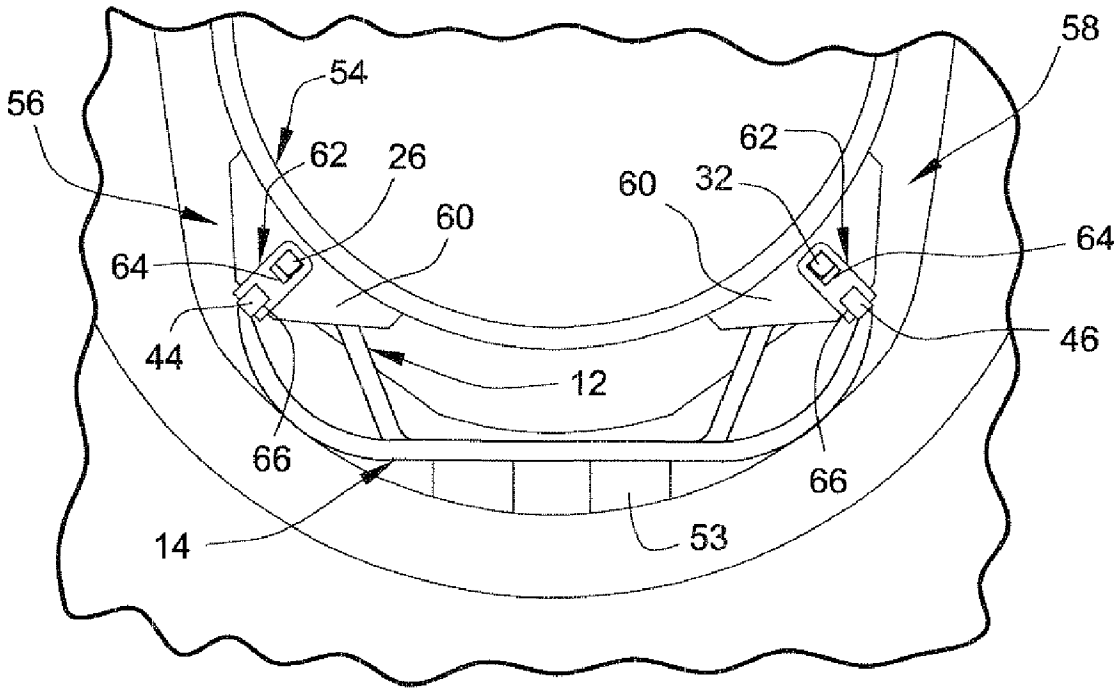
FIG. 6 is a partial perspective view of a the two-piece mounting bracket assembly of FIG. 1 supporting the forward end of a transition piece.

With reference now to FIG. 6, it may be seen that the mounting bracket assembly is secured on the combustor casing 53, and the forward end of the transition piece 54 is provided with a pair of mounting flanges 56, 58, each including a support web 60 welded to the sides of the transition piece, each support web carrying an H-block 62 with pass-through recesses 64, 66. Recesses 64,66 of one H-block are adapted to receive the securement tabs 24, 44 while similar recesses in the other H-block are adapted to receive securement tabs 32, 46. By having the H-blocks slidably engaged with the securement tabs as described above, the transition piece is secured radially and circumferentially, but is able to grow thermally in an axial direction. Elimination of welds provides greater wear capabilities between the H-blocks and the bracket assembly components.

As indicated earlier, the two piece mounting bracket assembly as described above may be used when an extended life of 24K hours is desired. However, in the event the 8K hours of service life is acceptable, the bracket component 14 may be used alone, with securement tabs 44, 46 located in the radially outer recesses 66 of the H-blocks.

The mounting bracket assembly 10 thus provides a degree of fexibility previously unknown in the support of transition pieces. In addition, elimination of current welding steps result in lower cost and longer life since welds are often a source of crack initiation. It will also be appreciated that the dual-component concept of the described mounting block assembly may be used with other machine components where service life and thermal expansion issues are extant.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A mounting bracket assembly comprising:

a first bracket component having a first base and a first pair of arms extending upwardly and outwardly from opposite ends of said first base and a first pair of laterally spaced securement tabs;

a second bracket component having a second base and a second pair of arms extending upwardly and outwardly from opposite ends of said second base and a second pair of laterally spaced securement tabs;

wherein said first and second bracket components are engageable with each other such that respective ones of each of said first and second pairs of securement tabs are located adjacent each other and adapted to engage corresponding pairs of recesses in a machine component.

2. The mounting bracket assembly of claim 1 wherein said second pair of arms lie laterally outwardly of said first pair of arms.

3. The mounting bracket assembly of claim 1 wherein said first pair of arms have remote ends that are provided with said first pair of securement tabs that extend in an axial direction.

4. The mounting bracket assembly of claim 3 wherein said second pair of arms have remote ends that are turned inwardly toward said first pair of arms, respectively, thereby forming said second pair of securement tabs.

5. The mounting bracket assembly of claim 1 wherein said first and second bracket components are engageable by means of a mating engaging surface on said first base formed by a first axially projecting flange that overlaps a mating engaging surface of the second base.

6. The mounting bracket assembly of claim 5 wherein said mating engaging surfaces are provided with respectively aligned holes for securing the mounting bracket assembly to the machine component.

7. The mounting bracket assembly of claim 1 wherein each of said first pair of arms include outer end portions that are angled relative to remaining portions thereof.

8. The mounting bracket assembly of claim 5 wherein the mating engaging surface of said second base comprises a second axially projecting flange.

9. The mounting bracket assembly of claim 8 wherein said first and second axially projecting flanges are shaped and arranged to interlock said first and second bracket components when fully overlapped and engaged with one another.

10. A mounting bracket component for securing one machine component to another machine component, said mounting bracket component comprising a first base portion with a first pair of arms extending upwardly and outwardly from said first base portion, said anus having in-turned edges forming a first set of securement tabs receivable in recesses formed in the other machine component, and said first base portion having a first mounting flange axially projecting from one side of said first base portion.

11. The mounting bracket component of claim 10 wherein said first mounting flange has an upper surface that is recessed relative to an upper surface of said first base portion.

12. The mounting bracket component of claim 10 wherein said first mounting flange is provided with at least one mounting hole.

13. The mounting bracket component of claim 10 in combination with a second mounting bracket having a second base portion and a second mounting flange that are engaged with said first base portion and said first mounting flange.

14. The mounting bracket component of claim 13 wherein said second mounting flange has a lower surface that is recessed relative to a lower surface of said second base portion.

15. The mounting bracket component of claim 13 wherein said second mounting flange is provided with at least one mounting hole aligned with said at least one mounting hole in said first mounting flange.

16. The mounting bracket component of claim 13 wherein said second mounting bracket further comprises a second pair of arms extending upwardly and outwardly from opposite ends of said second base portion, said second pair of arms foiined with remote inturned edges forming a second set of securement tabs adjacent and parallel to said first pair of securement tabs.

17. A method of securing a transition piece to a combustor casing without welding comprising:

providing a first mounting bracket component for attaching the transition piece to a turbine combustor casing, said first mounting bracket formed with a first set of securement tabs;

providing a second mounting bracket component that is usable with said first bracket component, said second mounting bracket component formed with a second set of securement tabs; and slidably engaging said transition piece with said first and second mounting bracket components, such that said first and second pairs of securement tabs are received within corresponding axially-aligned recesses provided on said transition piece, thereby permitting the transition piece to grow thermally relative to said first and second mounting bracket components.

* * * * *

UNITED STATES PATENT AND TRADEMARK OFFICE

CERTIFICATE OF CORRECTION

PATENT NO. : 7,918,433 B2
APPLICATION NO. : 12/213828
DATED : April 5, 2011
INVENTOR(S) : Patrick Melton et al.

It is certified that error appears in the above-identified patent and that said Letters Patent is hereby corrected as shown below:

In the Claims:

Claim 10, column 4, lines 42-44, delete “anus” and insert --arms--.

Claim 16, column 5, line 5, “foiined” should read --formed--.

Signed and Sealed this
Thirty-first Day of May, 2011

David J. Kappos

David J. Kappos
*Director of the United States Patent and Trademark Office*